US007401375B2

(12) United States Patent
McLeod

(10) Patent No.: US 7,401,375 B2
(45) Date of Patent: Jul. 22, 2008

(54) LINT REMOVAL APPARATUS

(76) Inventor: Pamela S. McLeod, 5535 Memorial Dr., Suite F610, Houston, TX (US) 77007

( * ) Notice: Subject to any disclaimer, the term of this patent is extended or adjusted under 35 U.S.C. 154(b) by 54 days.

(21) Appl. No.: 11/495,020

(22) Filed: Jul. 28, 2006

(65) Prior Publication Data

US 2007/0022550 A1 Feb. 1, 2007

Related U.S. Application Data

(60) Provisional application No. 60/703,250, filed on Jul. 29, 2005.

(51) Int. Cl.
*A47L 25/08* (2006.01)

(52) U.S. Cl. ..... 15/104.002

(58) Field of Classification Search ..... 15/104.001, 15/104.002, 143.1; 428/40.1
See application file for complete search history.

(56) References Cited

U.S. PATENT DOCUMENTS 2,724,847 A * 11/1955 Krasno ..... 15/104.002
3,151,346 A * 10/1964 Gray ..... 15/187
3,321,790 A * 5/1967 Hand ..... 15/104.001
3,389,416 A * 6/1968 Timms ..... 15/104.002
4,713,274 A * 12/1987 Minor ..... 428/40.1
5,742,969 A * 4/1998 Thomas et al. ..... 15/104.002

* cited by examiner

*Primary Examiner*—David B Thomas
(74) *Attorney, Agent, or Firm*—Raymond R. Ferrera

(57) ABSTRACT

A disposable lint removal device that is a ring shape with a flat square, rectangular, circular or other shaped piece of adhesive mounted onto it. Any finger slides into the ring with the mount piece either on top or bottom of the hand. A protective layer is removed from the adhesive mount, and then the sticky piece of adhesive is repetitively brought in and out of contact with the article to remove any particulate matter. Messages may be stored on the device for later retrieval.

4 Claims, 3 Drawing Sheets

LINT REMOVAL APPARATUS

STATEMENT OF RELATED CASES

This application claims the benefit of U.S. Provisional Application 60/703,250, filed Jul. 29, 2005.

FIELD OF THE INVENTION

The present invention relates to the maintenance of clothing including the removal of lint, dander, and other debris.

BACKGROUND OF THE INVENTION

Fabrics, including clothing and other garments, typically retain an electrostatic charge. This charge assists in attracting and collecting lint, hair, dust and other particulate matter. It is typically undesirable to have lint or debris of any sort on clothing. However, it is sometimes difficult or impossible to simply wipe lint or debris off clothing and other fabric items, especially under conditions where the act of wiping generates additional static electricity, resulting in additional attraction and collection.

Washing and dry cleaning provide a lint removal solution. Washing and drying cleaning are inefficient, time consuming and expensive. Typically, the need for removing lint is immediate in both time and location, where the lint needs to be removed without removal of the clothing and the task needs to be accomplished quickly, such as moments before being seated at a social function or being introduced to others.

Many other devices have been created to remove debris from fabrics using an adhesive. Notable examples follow from U.S. Pat. No. 2,607,711 of Aug. 19, 1952 to Hendricks, assigned to Minnesota Mining & Manufacturing Company of St. Paul, Minn.

U.S. Pat. No. 4,427,726 to Wolfrum teaches improvements to the adhesive-coated roll dispensed on a roller.

U.S. Pat. No. 3,029,453, RE 25,435 of Aug. 13, 1963 to Norman teaches a mitt-like dispenser with tacky-substance coated paper and a non-detachable protective cover sheet. In the alternative, Norman teaches a multi-finger holder for the dispenser, including the non-detachable protective cover sheet.

U.S. Pat. No. 4,820,558 to Sundberg teaches a bag-like device worn by the hand, the outer surface of the bag having an adhesive suitable for collecting particulate matter such as lint.

U.S. Pat. No. 5,894,623 to Thill teaches a hand-sized sheet held by one or two finger apertures. One or more of the user's fingers protrude through the apertures to be positioned in front of the adhesive surface, the fingers contacting the fabric or material being cleaned. A portion of the adhesive surface sticks to the fingernail backs of the inserted fingers. The hand-sized sheet is extracted from a bulk pad with the assistance of a release liner. The preferred square shape is dimensioned to approximately 4.5 inches by 5 inches.

These devices all suffer from lack of discreteness, in that all come with considerable bulk and size. Some of these devices claim to be disposable and portable, however none are small enough to justify carrying in a pocket or purse. The present invention dispenses with the need for a tool, such as a roller, and bulky reservoir, such as a pad of sheets. In particular, the present invention also dispenses with the requirement of the use of two or more fingers to hold the dispensing device, and further dispenses with the use of a non-detachable protective cover sheet. The present invention does not require the user's hands or fingers to contact the adhesive material. Further, none of the devices present themselves to efficiently communicate and store a message for later recollection or retrieval.

SUMMARY OF THE INVENTION

According to a first set of examples of the invention, there is provided a device for picking up lint, hair, dust and other small particles from a surface to which they may be lightly adhered, the device comprising: a first flexible sheet, the sheet having two sides, one side of which is coated with tacky composition and the other side of which is tacky-free, the composition being of such character that when the coated side is placed in contact with the surface, the particles on the latter are transferred to the coated side of the sheet; a removable covering sheet, the covering sheet being placed releasably upon the tacky-coated side of the first sheet so as to be peelable therefrom, and being adapted to be so peeled therefrom without destroying the tacky character of the side of the first flexible sheet; and a single finger mount disposed on the tacky-free side of the first flexible sheet.

In another example, the single finger mount of the above-described device comprises a second flexible sheet, the second flexible sheet having two parallel incisions along a portion of the distance of the sheet, the parallel incisions forming a strap separable from the tacky-free side of the first flexible sheet.

In another example, the single finger mount of the above-described device comprises two parallel incisions along a portion of the distance of the first flexible sheet, the parallel incisions forming a strap.

In another example, the single finger mount of the above-described device comprises a flexible strip, the flexible strip encircled to form a loop.

In another example, the single finger mount of the above-described device comprises: a first flexible strip extending from a first edge of the first flexible sheet; a second flexible strip extending from a second edge of the first flexible sheet, the second edge located approximately opposite from the first edge; and means to temporarily attach the ends of the first flexible strip and the second flexible strip to each other, thereby forming a loop.

In another example, the single finger mount of the above-described device is disposed in approximately the center of the first flexible sheet.

In another example, at least one surface of the removable covering sheet of the above-described device is adapted to receive imprinted images.

According to a second set of examples of the invention, there is provided a messaging device further adapted for picking up lint, hair, dust and other small particles from a surface to which they may be lightly adhered, the device comprising a single finger mounted lint removal device having at least one surface, wherein at least one surface of the lint removal device stores a displayable message for future retrieval.

According to a third set of examples of the invention, there is provided a system for lint removal, the system comprising: means for collecting lint from a surface; means for positioning the collector means using a single finger control; and means for protecting the collector means prior to use; wherein the protection means is detachable from the collector means; and wherein the positioning means does not contact the surface.

In another example, the collector means of the above-described system comprises a first flexible sheet, the sheet having two sides, one side of which is coated with tacky composition and the other side of which is tacky-free, the composition being of such character that when the coated side is placed in contact with the surface, the lint is transferred to the coated side of the sheet.

In another example, the protection means of the above-described system comprises a removable covering sheet, the covering sheet being placed releasably upon the collector means so as to be peelable therefrom.

In another example, the positioning means of the above-described system comprises a single finger mount disposed on the collector means. In a further example, the single finger mount comprises a flexible sheet, the flexible sheet having two parallel incisions along a portion of the distance of the sheet, the parallel incisions forming a strap separable from the collector means. In a further example, the single finger mount comprises a flexible strip, the flexible strip encircled to form a loop. In a further example, the single finger mount comprises: a first flexible strip extending from a first edge of the collector means; a second flexible strip extending from a second edge of the collector means, the second edge located approximately opposite from the first edge; and means to temporarily attach the ends of the first flexible strip and the second flexible strip to each other, thereby forming a loop. In a further example, the single finger mount is disposed in approximately the center of the collector means.

In another example, the protection means of the above-described system comprises at least one surface adapted to receive imprinted images.

In another example, the above-described system further comprises means for storing a displayable message for future retrieval.

BRIEF DESCRIPTION OF THE SEVERAL DRAWINGS

DETAILED DESCRIPTION

Each of FIGS. 1-4 illustrates a lint engagement device embodying various aspects of the present invention, though these particular embodiments are illustrated and described herein only for exemplary purposes. Moreover, variations of the lint engagement device and methods of utilizing the same will become apparent to those of ordinary skill in the relevant structural and mechanical arts upon reading the following disclosure. Thus, the present invention is not to be considered limited to only the structures, systems, and methods described herein.

Figure 1:
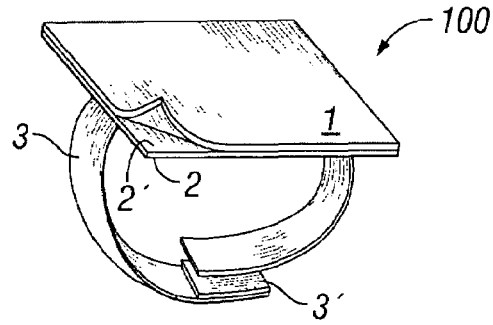
FIG. 1 is a 3-D perspective frontal view of the lint engagement device of the present invention.

As illustrated in FIG. 1, there is provided a 3-D perspective frontal view of the lint engagement device 100 of the present invention. As used herein, the term lint includes a wide variety of particles that may become deposited on a surface, clothing or fabric. Three main components provide examples of the means necessary to carry out the invention: a removable covering sheet 1, a first flexible sheet 2, and a ring mount 3. One surface of flexible sheet 2 is coated with a tacky composition 2', providing a collector surface and means for collecting the lint. Removable covering sheet 1 is disposed on or over tacky composition 2', preventing premature consumption of the adhesive properties and further providing a means for protecting the collector surface. Ring mount 3 is disposed on a non-tacky surface of flexible sheet 2, typically opposite from the surface containing the tacky composition.

Tacky composition 2' may be any of a variety of glues, membranes, tapes, gummi, or other surfaces with composition or structure being of such character that when contact with is made with a subject surface, particles residing on the subject surface are transferred to the tacky composition on the flexible sheet.

Ring mount 3 is shown with an adhesive connector 3' to form the loop. It can be appreciated that other configurations for ring mount 3 are possible which may or may not include the need for connector 3'. Ring mount 3 generally does not come into contact with the subject surface being cleaned.

Removable covering sheet 1 may be any of a variety of partially adherent substances, such as wax coated paper, plastic film or sheet, plasticized paper, being of such character as to be peelable from tacky composition 2' and flexible sheet 2 without damage to either the tacky character of tacky composition 2' or the integrity of flexible sheet 2.

Either surface of removable covering sheet 1 may be adapted to receive imprinted images or messages, which may be printed in readable form or encoded for future retrieval by a machine. For example, the outer surface 1' may contain a printed announcement or advertisement. These messages may be used to impart sponsorship information, remind a person of a favorite restaurant, or provide a coupon for later use. It can be appreciated that the relatively small surface area is ideally suited to embed or imprint a bar code, a domain name, a pass-code, or a radio frequency identification tag, allowing the holder of the lint engagement device 100 access to additional information or sponsorship benefits. For example, a restaurant may provide lint engagement devices 100 to their customers, who appreciate the immediate utility of cleaning lint from their clothes during their meal engagement. Customers may take additional lint engagement devices 100 to put in their purse, wallet, glove-box, or pockets for future use. At a later time, upon seeing the lint engagement devices, customers are reminded of the restaurant. In a further example, the lint engagement devices 100 may have internet domain name codes that allow the customer to access discounts or special events at the restaurant. In a like example, dry cleaning companies may provide lint engagement devices 100 to their customers to help remind them to continue doing business with their establishment.

Figure 2:
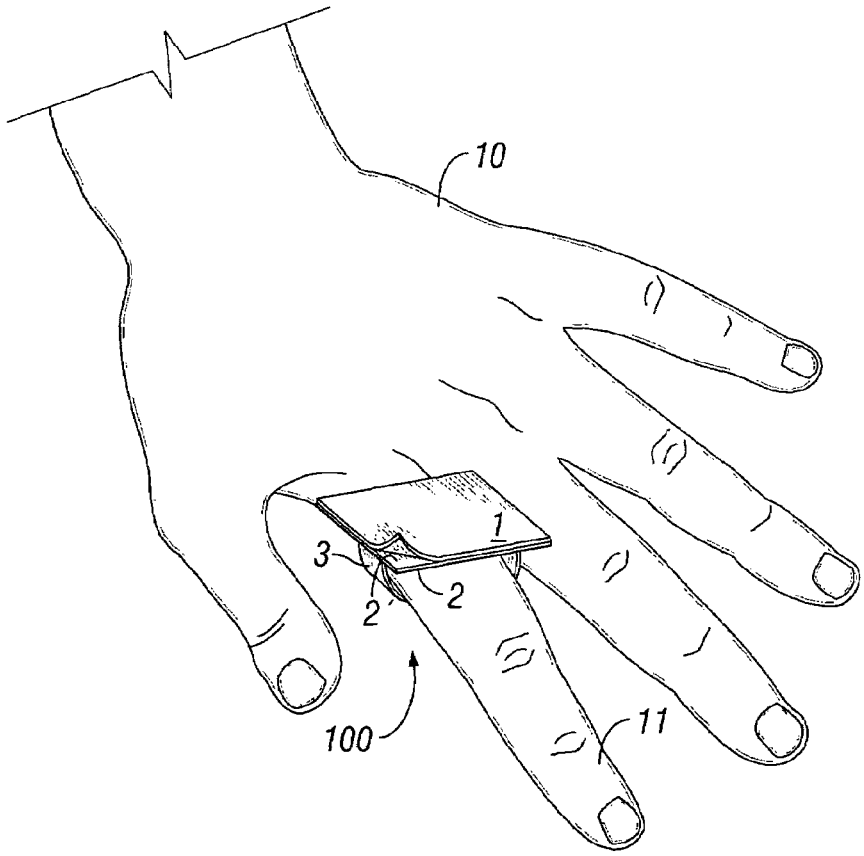
FIG. 2 is a 3-D perspective frontal view of the lint engagement device of the present invention, shown in one mode of use on a hand.

As illustrated in FIG. 2, there is provided a 3-D perspective frontal view of the lint engagement device 100 of the present invention, shown in one mode of use on a hand 10. The loop formed by finger mount 3 is used to allow a single finger 11 to be inserted into the lint engagement device 100. It can be appreciated that any finger or thumb may be chosen to operate lint engagement device 100, depending on the need and comfort of the user. Flexible sheet 2 is sized to be comfortably controlled by a single finger mount. As illustrated in this example, lint engagement device 100 is worn similar to a ring, allowing the surface containing tacky composition 2' to be exposed on the back of the hand 10. At no point are the fingers or portions of the hand prone to come between the adhesive surface, tacky composition 2', and the surface to be cleaned. Removable covering sheet 1 is completely removable or otherwise detachable from flexible sheet 2 to avoid obstructing contact of tacky composition 2' with the surface to be cleaned. Further, removable covering sheet 1, once removed, will typically not be needed, as lint engagement device 100 will be discarded after one use, owing to the small surface area of flexible sheet 2 and the intended consumption dedicated to the immediate cleaning need at hand. Removable covering sheet 1 may be discarded, used for future reference or information retrieval, or used for any redemption or offering established by the imprinting on removable covering sheet 1.

Figure 3A:
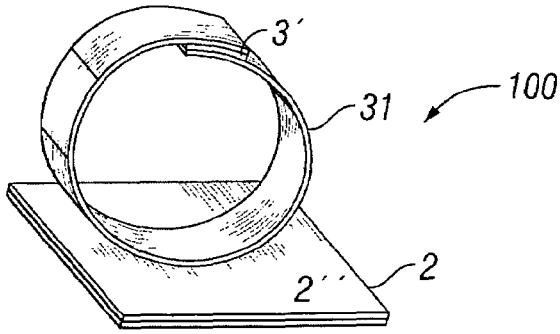
FIG. 3A is a 3-D perspective rear view of the lint engagement device of the present invention, showing one example of a ring finger mount.

As illustrated in FIG. 3A, there is provided a 3-D perspective rear view of the lint engagement device 100 of the present invention, showing one example of means for positioning the engagement device by control of a single finger, ring finger mount 31. Ring mount 31 is shown as a single strip of flexible material disposed in approximately the center on the non-tacky surface 2" of flexible sheet 2. Ring mount 31 is shown with an adhesive connector 3' to form the loop. It can be appreciated that other configurations for ring mount 31 are possible which may or may not include the need for connector 3'. Further alternate examples include placing connector 3' at the point of disposal on flexible sheet 2, or disposing both ends of the strip of ring mount 31 at slightly differing points on flexible sheet 2. In all such combinations of structural configuration, ring mount 31 is formed by creating a loop from a flexible strip such that a finger may be inserted, thereby providing control of movement of flexible sheet 2.

Figure 3B:
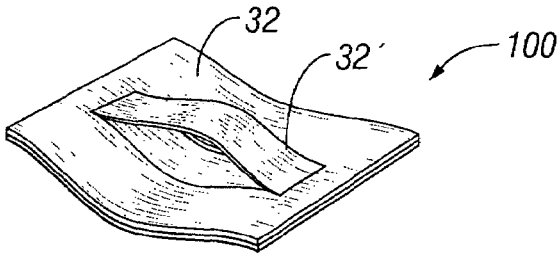
FIG. 3B is a 3-D perspective rear view of the lint engagement device of the present invention, showing one example of an aperture finger mount.

As illustrated in FIG. 3B, there is provided 3-D perspective rear view of the lint engagement device 100 of the present invention, showing one example of an aperture finger mount 32. In this example, finger mount 32 forms an additional sheet disposed on the non-tacky surface of flexible sheet 2. Two parallel incisions are made along a portion of the distance of the sheet of finger mount 32. The parallel incisions form a strap 32' which may be separated from flexible sheet 2, especially when the entire lint engagement device 100 is slightly flexed or the opposite edges are squeezed towards one another, as illustrated. Ring mount 32 is formed by creating a loop from strap 32' separating from flexible sheet 2 such that a finger may be inserted, thereby providing control of movement of flexible sheet 2.

Figure 3C:
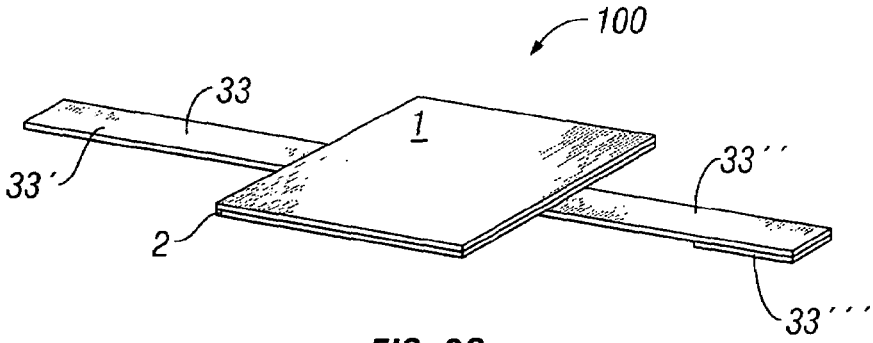
FIG. 3C is a 3-D perspective rear view of the lint engagement device of the present invention, showing one example of a strip finger mount.

As illustrated in FIG. 3C, there is provided a 3-D perspective rear view of the lint engagement device 100 of the present invention, showing one example of a strip finger mount 33. In this example, finger mount 33 forms a first flexible strip 33' extending from a first edge of flexible sheet 2 and a second flexible strip 33" extending from a second edge of flexible sheet 2, preferably with the second edge located approximately on the opposite side from the first edge. A connector 33'" or other means may be used to temporarily attach the ends of flexible strip 33' and flexible strip 33" to each other, thereby forming a loop. It can be appreciated that flexible strip 33' and flexible strip 33" may be integrated into a single strip disposed on flexible sheet 2. In another example, flexible strip 2 may be cut such that flexible strip 33' and flexible strip 33" are extensions of flexible strip 2. In all such combinations of structural configuration, ring mount 33 is formed by creating a loop from a flexible strip such that a finger may be inserted, thereby providing control of movement of flexible sheet 2.

Figure 4:
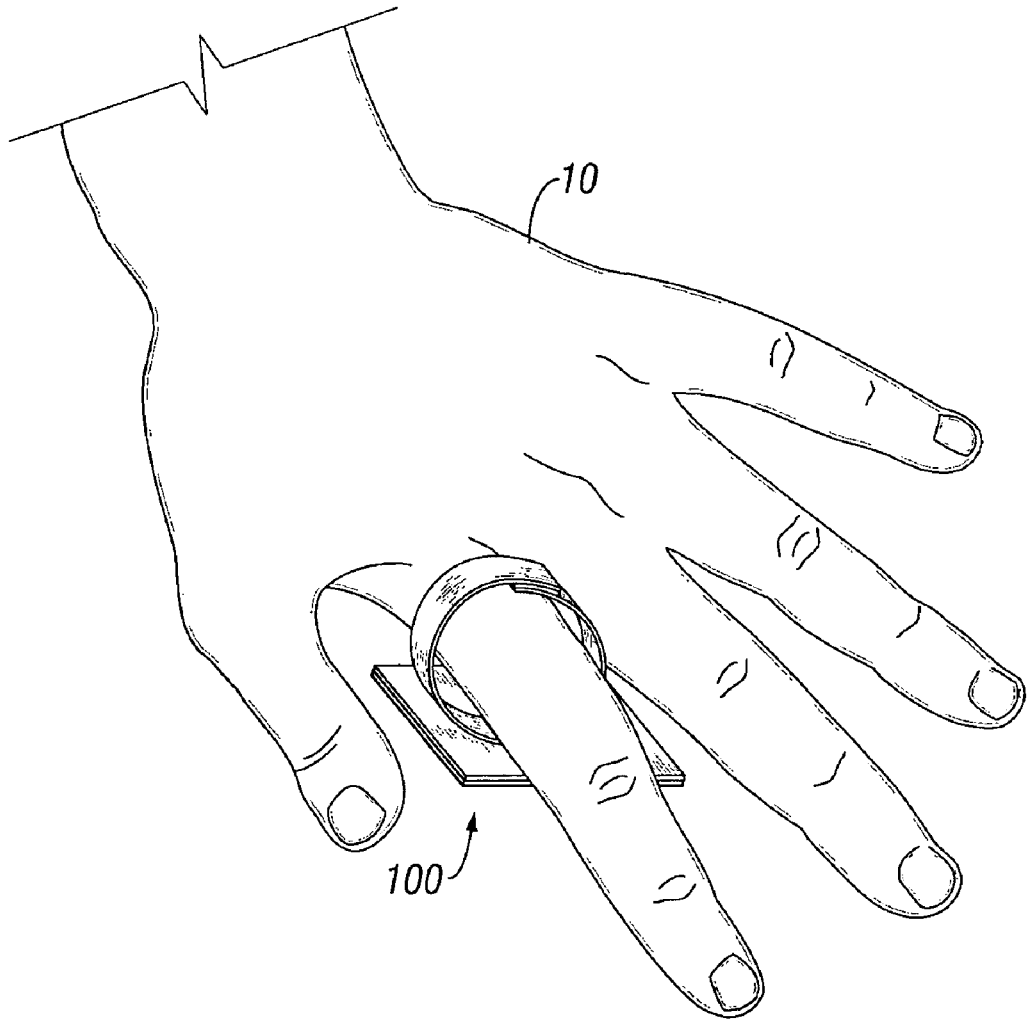
FIG. 4 is a 3-D perspective view of the lint engagement device of the present invention, shown in an alternate mode of use on a hand.

As illustrated in FIG. 4, there is provided a 3-D perspective view of the lint engagement device 100 of the present invention, shown in an alternate mode of use on a hand 10. As illustrated in this example, lint engagement device 100 is worn similar to a ring rotated one hundred eighty degrees, allowing the surface containing tacky composition 2' to be exposed in the palm side of the hand 10. At no point are the fingers or portions of the hand required to come between the adhesive surface, tacky composition 2', and the surface to be cleaned.

Thus, the foregoing description is presented for purposes of illustration and description, and is not intended to limit the invention to the forms disclosed herein. Consequently, variations and modifications commensurate with the above teachings and the teaching of the relevant art are within the spirit of the invention. Such variations will readily suggest themselves to those skilled in the relevant structural or mechanical art. Further, the embodiments described are also intended to explain the best mode for practicing the invention, and to enable others skilled in the art to utilize the invention and such or other embodiments and with various modifications required by the particular applications or uses of the invention. It is intended that the appended claims be construed to include alternative embodiments to the extent that is permitted by prior art.

What is claimed is:

1. A device for picking up lint, hair, dust and other small particles from a surface to which they may be lightly adhered, said device comprising:

a first flexible sheet, said sheet having two sides, one side of which is coated with tacky composition and the other side of which is tacky-free, said composition being of such character that when said coated side is placed in contact with said surface, said particles on the latter are transferred to said coated side of the sheet;

a removable covering sheet, said covering sheet being placed releasably upon said tacky-coated side of the first sheet so as to be peelable therefrom, and being adapted to be so peeled therefrom without destroying the tacky character of said side of the first flexible sheet; and a single finger mount disposed on said tacky-free side of said first flexible sheet, wherein said single finger mount comprises two parallel incisions along a portion of the distance of said first flexible sheet, said parallel incisions forming a strap.

2. A device for picking up lint, hair, dust and other small particles from a surface to which they may be lightly adhered, said device comprising:

a first flexible sheet, said sheet having two sides, one side of which is coated with tacky composition and the other side of which is tacky-free, said composition being of such character that when said coated side is placed in contact with said surface, said particles on the latter are transferred to said coated side of the sheet;

a removable covering sheet, said covering sheet being placed releasably upon said tacky-coated side of the first sheet so as to be peelable therefrom, and being adapted to be so peeled therefrom without destroying the tacky character of said side of the first flexible sheet; and a single finger mount disposed on said tacky-free side of said first flexible sheet, wherein said single finger mount further comprises:

a first flexible strip extending from a first edge of said first flexible sheet;

a second flexible strip extending from a second edge of said first flexible sheet, said second edge located approximately opposite from said first edge; and means to temporarily attach the ends of said first flexible strip and said second flexible strip to each other, thereby forming a loop.

3. A system for lint removal, the system comprising:

means for collecting lint from a surface;

means for positioning said collector means using a single finger control; and means for protecting said collector means prior to use;

wherein said protection means is detachable from said collector means; and wherein said positioning means does not contact the surface; comprises a single finger mount disposed on said collector means; and further comprises a flexible strip, said flexible strip encircled to form a loop.

4. A system for lint removal, the system comprising:

means for collecting lint from a surface;

means for positioning said collector means using a single finger control; and means for protecting said collector means prior to use;

wherein said protection means is detachable from said collector means; and wherein said positioning means does not contact the surface; comprises a single finger mount disposed on said collector means; and wherein said single finger mount comprises:

a first flexible strip extending from a first edge of said collector means;

a second flexible strip extending from a second edge of said collector means, said second edge located approximately opposite from said first edge; and means to temporarily attach the ends of said first flexible strip and said second flexible strip to each other, thereby forming a loop.

* * * * *